US009585430B1

(12) United States Patent
Singh

(10) Patent No.: US 9,585,430 B1
(45) Date of Patent: Mar. 7, 2017

(54) FLIP AND CHANGE SYSTEMS

(71) Applicant: Gurmal K. Singh, El Cajon, CA (US)

(72) Inventor: Gurmal K. Singh, El Cajon, CA (US)

( * ) Notice: Subject to any disclaimer, the term of this patent is extended or adjusted under 35 U.S.C. 154(b) by 395 days.

(21) Appl. No.: 13/895,178

(22) Filed: May 15, 2013

Related U.S. Application Data

(60) Provisional application No. 61/647,738, filed on May 16, 2012.

(51) Int. Cl.
*A42B 1/04* (2006.01)
*A45D 44/12* (2006.01)
*A42B 1/18* (2006.01)

(52) U.S. Cl.
CPC ..... *A42B 1/04* (2013.01); *A42B 1/18* (2013.01); *A45D 44/12* (2013.01)

(58) Field of Classification Search
CPC ..... A42B 1/04; A42B 1/18; A45D 44/12
USPC ..... 2/46, 48, 52, 174, 202, 206; 132/274
See application file for complete search history.

(56) References Cited

U.S. PATENT DOCUMENTS 1,897,100 A * 2/1933 Abbott ..... A42B 1/045 132/274
1,909,686 A * 5/1933 Kindall ..... A42B 1/208 2/171.5
2,017,328 A * 10/1935 Taylor ..... A42B 1/046 2/174
2,045,359 A 6/1936 Kline
2,379,722 A * 7/1945 Kase ..... A45D 44/08 2/50
2,445,487 A * 7/1948 Lester ..... A42B 1/046 2/174
2,484,269 A * 10/1949 Carlson ..... A42B 1/046 2/174
4,457,027 A * 7/1984 Gladstone ..... A42B 1/046 2/174
4,698,853 A * 10/1987 Walton ..... A42B 1/046 2/174
4,722,100 A 2/1988 Greer
4,887,316 A * 12/1989 Morandini ..... A45D 8/40 2/174
5,572,740 A 11/1996 Geniesse
5,617,584 A * 4/1997 Brennan ..... A41D 13/11 2/172
6,131,203 A * 10/2000 Cominsky ..... A42B 1/046 2/202
7,380,284 B1 6/2008 Dodani
7,788,735 B1 9/2010 Foulks
2009/0083893 A1 4/2009 Bergman et al.

* cited by examiner

*Primary Examiner* — Katherine Moran
(74) *Attorney, Agent, or Firm* — Garrett James O'Sullivan

(57) ABSTRACT

'Flip and Change' allows users to confidently change clothing without worrying about staining their clothes. The invention has two pieces of silk or polyester material that can be attached to a neck strap held together by hook-and-loop-fasteners. Other materials and fastening means may be used. Once the user has secured the neck strap, he/she may tuck the shorter piece of material into his or her collar or behind the front of the shirt (on the inside), while the longer piece may be flipped up to cover the face. When the (main) garment (such as a shirt or blouse) is removed, the invention prevents makeup from transferring to the clothing. The longer piece of material may include a decorative knot at the end.

12 Claims, 6 Drawing Sheets

FLIP AND CHANGE SYSTEMS

CROSS-REFERENCE TO RELATED APPLICATION

The present application is related to and claims priority from prior provisional application Ser. No. 61/647,738, filed May 16, 2012 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of garment protectors and more specifically relates to a flip and change garment device.

2. Description of the Related Art

Many individuals in modern society, especially women, wear makeup to accentuate their appearance. People wear clothes that may be changed while wearing makeup. When changing clothes after work, after a workout or in a store changing room, people typically pull the garment over their head. This motion allows the shirt or dress to press against the face, which can transfer make up, oil and dirt to the material. This can leave a stain on the garment that can be difficult to remove, and a user may end up sending clothing to be dry-cleaned more often than he or she would like. If a person tries to avoid the face when removing the garment, the garment may become stretched and then it may not fit correctly. An effective solution is desirable whereby clothing may be protected and makeup is not smeared or otherwise affected.

Various attempts have been made to solve the above-mentioned problems such as those found in U.S. Pat. Nos. 2,045,359; 7,380,284; 5,572,740; 7,788,735; 4,722,100; and Pub. No. 2009/0083893. This art is representative of garments for use with make-up. None of the above inventions and patents, taken either singly or in combination, is seen to describe the invention as claimed.

Ideally, a flip and change garment device of the flip and change system should provide protection for clothing and for makeup and, yet would operate reliably and be manufactured at a modest expense. Thus, a need exists for a reliable flip and change garment device to avoid the above-mentioned problems.

BRIEF SUMMARY OF THE INVENTION

In view of the foregoing disadvantages inherent in the known garment protection art, the present invention provides a novel flip and change system. The general purpose of the present invention, which will be described subsequently in greater detail is to provide garment protection.

Flip and Change provides consumers with a way to keep clothing looking better, longer. The invention preferably includes two pieces of thin material with a neck strap. One piece of material may be flipped over the head to prevent makeup, sweat, dirt or other materials from staining or marking the clothing as the user's shirt is removed and another is put on. The invention is ideal for home use, or for department store and boutique owners who do not want make up and sweat on their merchandise.

A flip and change system is disclosed herein, in a preferred embodiment, comprising a flip and change assembly having a neck strap comprising an adjustable circular band, a first garment portion, a second garment portion, and preferably a decorative knot that functions as a balancer on the first garment portion such that the device stays properly positioned during wear. The flip and change system comprises the flip and change assembly; wherein the flip and change assembly comprises in combination the neck strap, the first garment portion and the second garment portion. The flip and change assembly preferably comprises silk; however other materials may be used in alternate embodiments.

The first garment portion is in communication with the neck strap; the first garment portion located at a front-facing section of the neck strap when the flip and change assembly is worn about a neck of a wearer-user. The neck strap may comprise a non-continuous adjustable circular band having a first end and a second end, in preferred embodiments such that it is readily adjustable; wherein the first end and the second end are removably couplable to each other, each of the first end and the second end comprising at least one fastener. The at least one fastener preferably comprises hook and loop fastening means.

The first garment portion comprises a greater length than that of the second garment portion; the first garment portion is designed to be flipped up to cover a face of the wearer-user and flipped down to cover a nape of the neck when worn. When down, the present invention prevents cool drafts from reaching the nape of the neck and further serves as a decorative and fashionable embellishment. The decorative knot serves to minimize undesirable side-to-side movement. In preferred embodiments the first garment portion comprises a triangular shape to match a nape-neckline; wherein the first garment portion is stain-resistant to avoid stains being transferred from makeup on the face of the wearer-user. The first garment portion is used as an isolator between the face and the garment being worn when a main-garment (such as a shirt, blouse, or the like) is pulled along the length of the face as it is removed over the head of the wearer-user to change clothes.

The second garment portion is in communication with the neck strap; the second garment portion also connected to the neck strap; wherein the second garment portion is designed to be tuck-coupled to the main-garment worn by the wearer-user. The first garment portion occupies an outer position in relation to the second garment portion; the second garment portion adjacent the neck when worn. In preferred embodiments the first garment portion and the second garment portion are integral with the neck strap, in alternate embodiments the present invention may be modular (separate joined components). The first garment portion is designed to be flipped up to cover the face of the wearer-user when the wearer-user is changing the main-garment to an alternate-garment (another item of clothing); the first garment portion providing an isolator between the face and the main-garment such that makeup is not transferred from the face to the main-garment. The second garment portion anchors the flip and change assembly in position during wear, and in this way the flip and change assembly comprises a decorative and functional scarf (multi-purpose) to prevent damage from occurring to the main-garment and to prevent smearing of the makeup on the face of the wearer-user. The feature that makeup is not smeared constitutes a savings on purchase of makeup and time that would normally be wasted in fixing makeup a second time for wear in public.

A method of using a flip and change is also disclosed herein comprising the steps of: donning a main-garment, putting on a flip and change assembly, applying makeup onto the face of the user, and flipping a first garment portion upwards to cover the face when removing the main-garment to exchange it for wear with an alternate-garment to prevent the makeup from contacting and transferring to the main-garment. The method may further comprise the step of donning the alternate-garment. The method may further yet comprise the step of flipping down the first garment portion to cover a neckline for wear with the alternate-garment serving as a functional and decorative scarf.

The present invention holds significant improvements and serves as a flip and change system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, flip and change system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a garment device and more particularly to a flip and change system as used to improve the protection of garments from staining and makeup from being smeared on the face of the wearer.

Generally speaking, 'Flip and Change' allows users to confidently change clothing without worrying about staining their clothes. The invention preferably comprises two pieces of silk or polyester material that can be attached to a neck strap held together by hook-and-loop-fasteners. Other materials and fastening means may be used. Once the user has secured the neck strap, he/she may tuck the shorter piece of material into his or her collar or behind the front of the shirt (on the inside), while the longer piece may be flipped up to cover the face. When the (main) garment (such as a shirt or blouse) is removed, the invention prevents makeup from transferring to the clothing. The longer piece of material may include a decorative knot at the end. The material may come in a variety of sizes, colors and patterns to fit the style of the individual user. The present invention is suitable for wear with various forms of upper body garments despite the neckline.

Figure 1B:
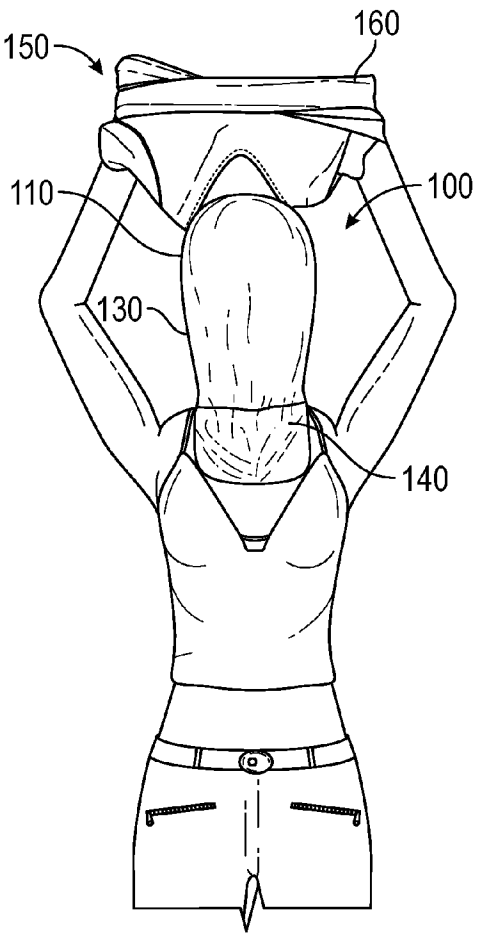
FIG. 1B shows a perspective view of the flip and change system in use, according to an embodiment of the present invention.
Figure 1A:
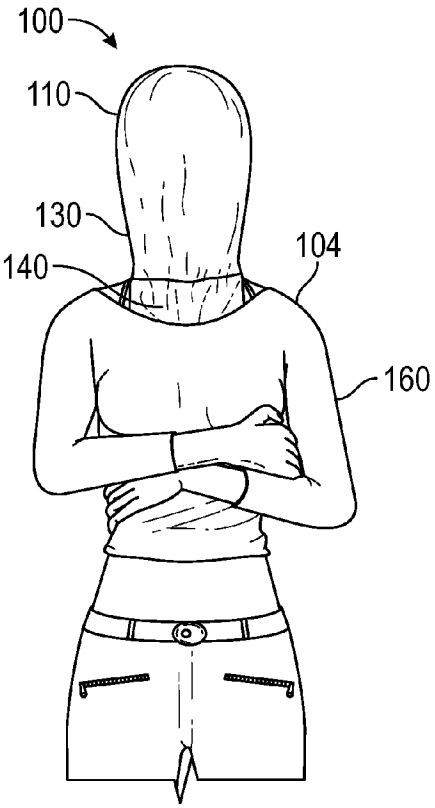
FIG. 1A shows a perspective view of a flip and change system in use, according to an embodiment of the present invention.
Figure 4B:
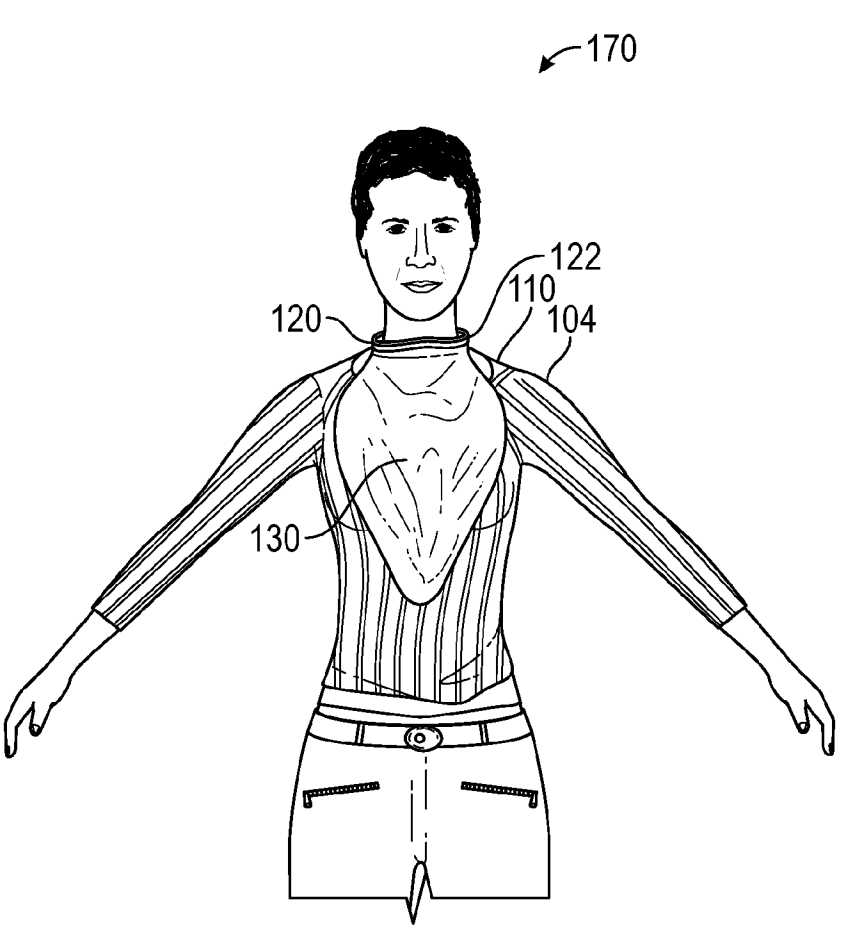
FIG. 4B shows a perspective view of the flip and change system in the as-worn condition, according to an embodiment of the present invention.
Figure 4A:
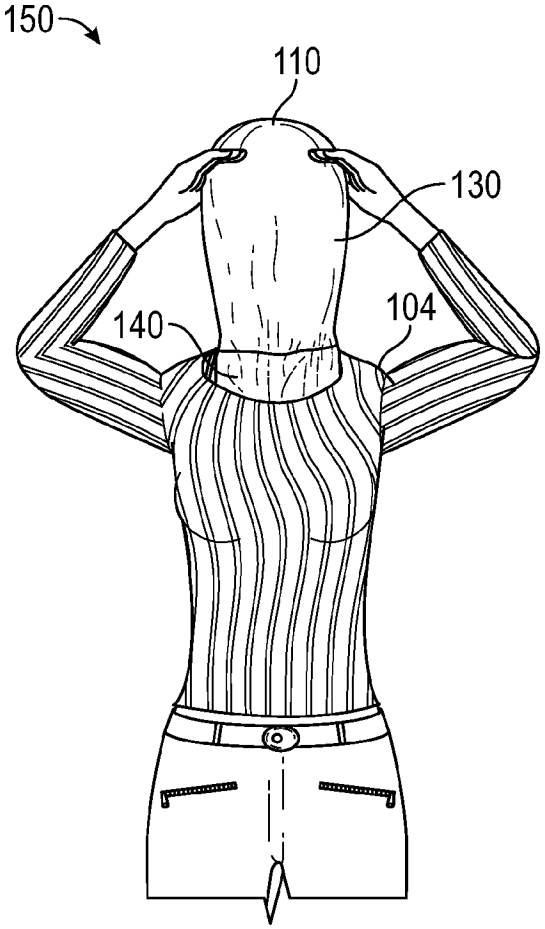
FIG. 4A shows a perspective view of the flip and change system in use, according to an embodiment of the present invention.

Referring to the drawings by numerals of reference there is shown in FIGS. 1A and 1B, a perspective view illustrating flip and change system 100 in an in-use condition 150 according to an embodiment of the present invention. These particular figures show how the present invention is used initially to remove main-garment 160. FIGS. 4A and 4B show wearer-user 104 after the new changed garment is put on for wear.

Flip and change system 100 comprises flip and change assembly 110 having neck strap 120 comprising adjustable circular band 122; first garment portion 130; second garment portion 140; wherein flip and change system 100 comprises flip and change assembly 110. Flip and change assembly 110 preferably comprises in combination neck strap 120, first garment portion 130 and second garment portion 140; wherein first garment portion 130 is in communication with neck strap 120, first garment portion 130 located at a front-facing section of neck strap 120 when flip and change assembly 110 is worn about a neck of wearer-user 104.

First garment portion 130 comprises a greater length than that of second garment portion 140. First garment portion 130 is designed to be flipped up (in-use condition 150) to cover a face of wearer-user 104 and flipped down to cover a nape of the neck when worn (as-worn condition 170), as previously mentioned. Second garment portion 140 is in communication with neck strap 120; second garment portion 140 connected to neck strap 120. Second garment portion 140 is designed to be tuck-coupled to main-garment 160 worn by wearer-user 104.

First garment portion 130 is designed to be flipped up to cover the face of wearer-user 104 when wearer-user 104 is changing main-garment 160 to an alternate-garment. First garment portion 130 provides an isolator (isolating means) between the face and main-garment 160 such that makeup is not transferred from the face to main-garment 160; second garment portion 140 anchoring flip and change assembly 110 in position during wear (as-worn condition 170). In this way flip and change assembly 110 comprises a decorative and functional scarf to prevent damage to main-garment 160 and to prevent smearing of makeup.

Neck strap 120 in certain embodiments comprises a continuous version of adjustable circular band 122; adjustable circular band 122 in these embodiments comprising elastic (elastically deformable) material such that the adjustable circular band 122 is able to fit to various sizes of the neck(s). First garment portion 130 and second garment portion 140 may be integral or non-integral with neck strap 120.

Figure 2B:
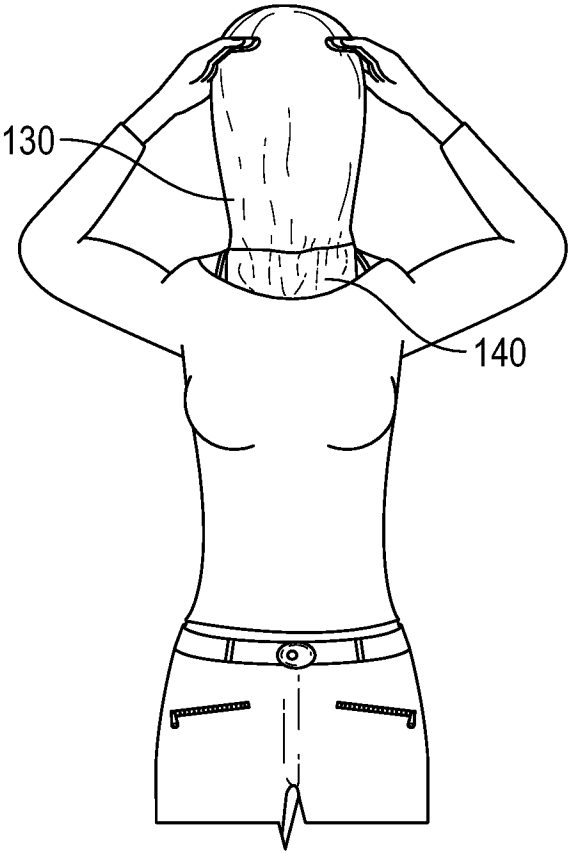
FIG. 2B shows a perspective view of the flip and change system in use, according to an embodiment of the present invention.
Figure 2A:
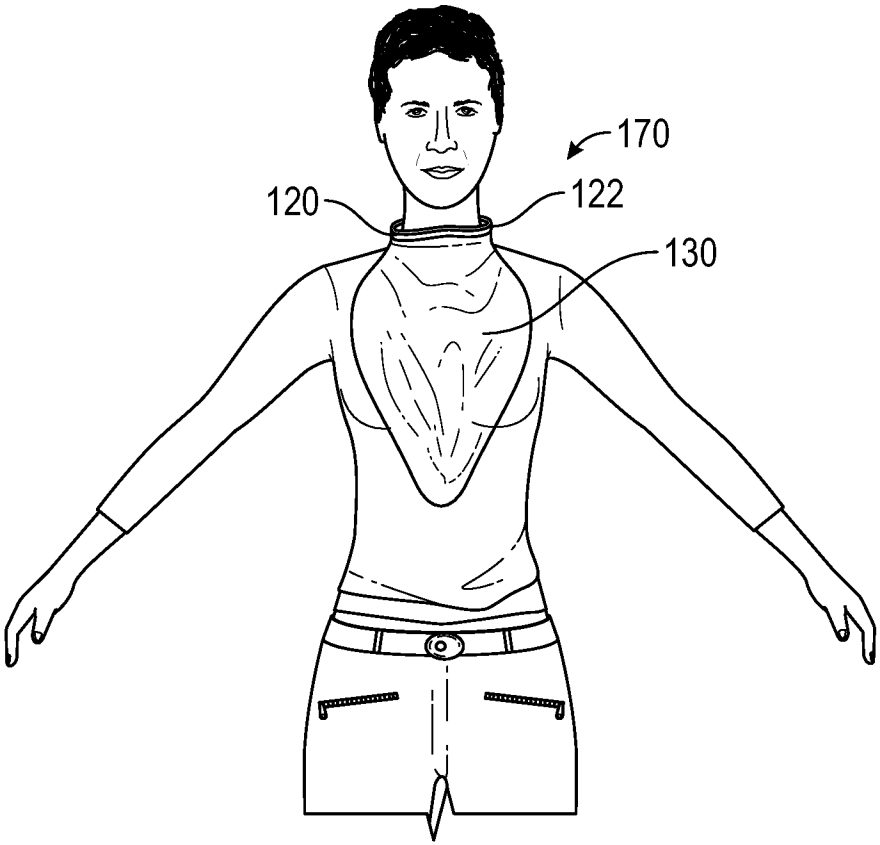
FIG. 2A shows a perspective view of the flip and change system in an as-worn condition, according to an embodiment of the present invention.
Figure 3A:
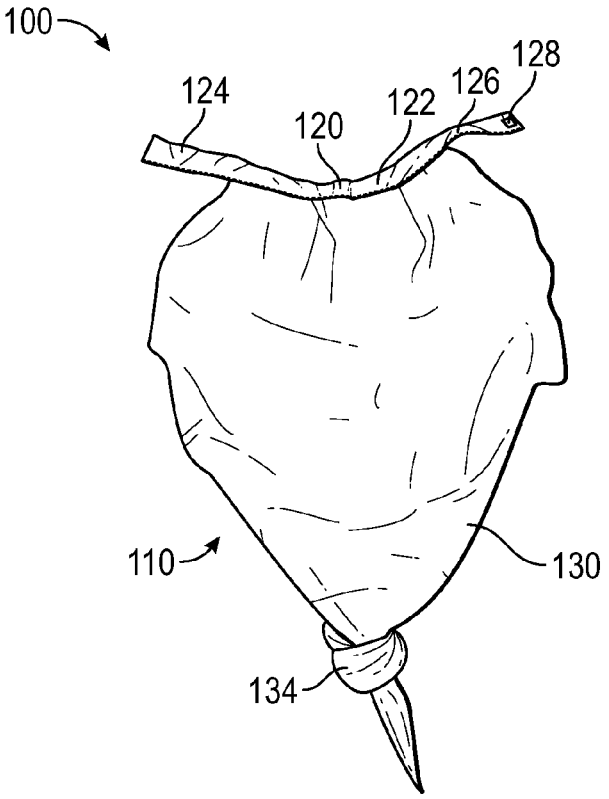
FIG. 3A shows a front perspective view of the flip and change system having a knot tied in the first garment portion, according to an embodiment of the present invention.
Figure 3B:
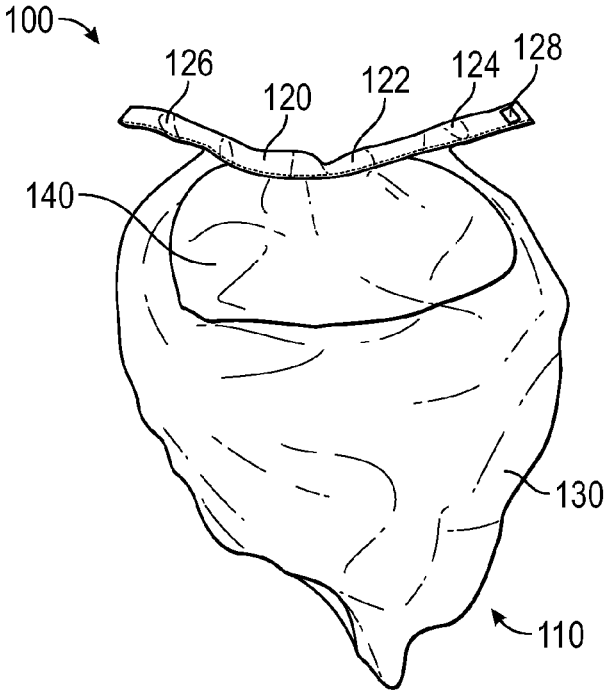
FIG. 3B shows a rear perspective view of the flip and change system, according to an embodiment of the present invention.
Figure 3C:
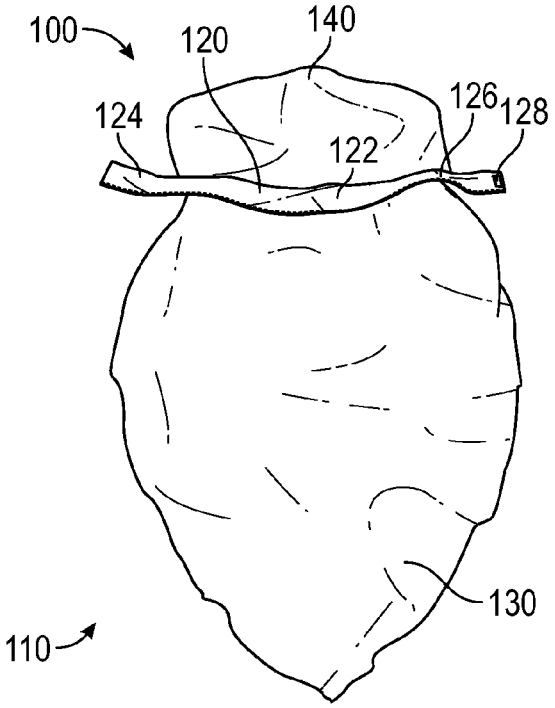
FIG. 3C shows a front perspective view of the flip and change system with the second garment portion flipped up, according to an embodiment of the present invention.
Figure 3D:
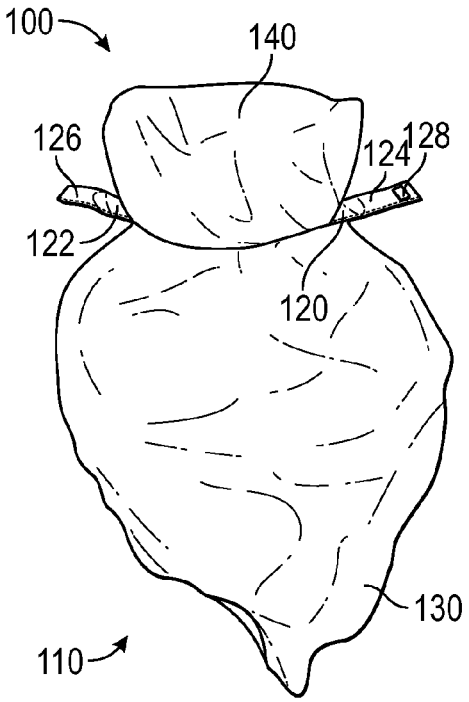
FIG. 3D shows a rear perspective view of the flip and change system with the second garment portion flipped up, according to an embodiment of the present invention.

Referring now to FIGS. 2A and 2B, perspective views illustrating flip and change assembly 110 in an as-worn condition 170 (FIG. 2A) and flip and change assembly 110 in an in-use condition 150 (FIG. 2B) are shown.

Flip and change assembly 110 comprises neck strap 120, as previously mentioned, which preferably comprises a non-continuous adjustable circular band 122 has first end 124 and second end 126 in preferred embodiments. In this particular embodiment first end 124 and second end 126 are removably couplable to each other, each of first end 124 and second end 126 comprising at least one fastener 128; wherein the at least one fastener 128 preferably comprises hook and loop. Alternately, fastener 128 may comprise snap(s); or clip(s) or the like. Upon reading this specification, it should be appreciated that, under appropriate circumstances, considering such issues as user preferences, design preference, structural requirements, marketing preferences, cost, available materials, technological advances, etc., other fastening arrangements such as, for example, clasps, hooks, folds, etc., may be sufficient.

Referring now to FIGS. 3A through 3D, perspective views illustrating flip and change assembly 110, according to an embodiment of the present invention, are shown.

Flip and change system 100 comprises flip and change assembly 110; flip and change assembly 110 comprises silk or polyester in preferred embodiments. Upon reading this specification, it should be appreciated that, under appropriate circumstances, considering such issues as user preferences, design preference, structural requirements, marketing preferences, cost, available materials, technological advances, etc., other materials such as, for example, wool, synthetic, non-synthetic, etc., may be sufficient. First garment portion 130 of flip and change assembly 110 may further comprise decorative knot 134 that also functions as a balancer as previously described to prevent side-to-side movement.

Referring now to FIGS. 4A and 4B, perspective views illustrating flip and change assembly 110 being returned from an in-use condition 150 (FIG. 4A) to the as-worn condition 170 (FIG. 4B), as according to an embodiment of the present invention, are shown. These particular figures show how the present invention is used for normal wear in the as-worn condition 170 with the changed garment (final stage).

First garment portion 130 is effectively stain-resistant (non-porous) in that it doesn't absorb makeup, or other debris/materials. First garment portion 130 preferably comprises a substantially triangular shape to match a nape-neckline and to appear as a scarf (both decorative and functional). First garment portion 130 occupies an outer position in relation to second garment portion 140; second garment portion 140 adjacent the neck when worn. Second garment portion 140 may comprise a square shape to sit behind the nape-neckline of main-garment 160 to increase anchoring by increasing a contact surface area with main-garment 160. Various shapes may be used such as V-shaped, half-oval or the like.

Figure 5:
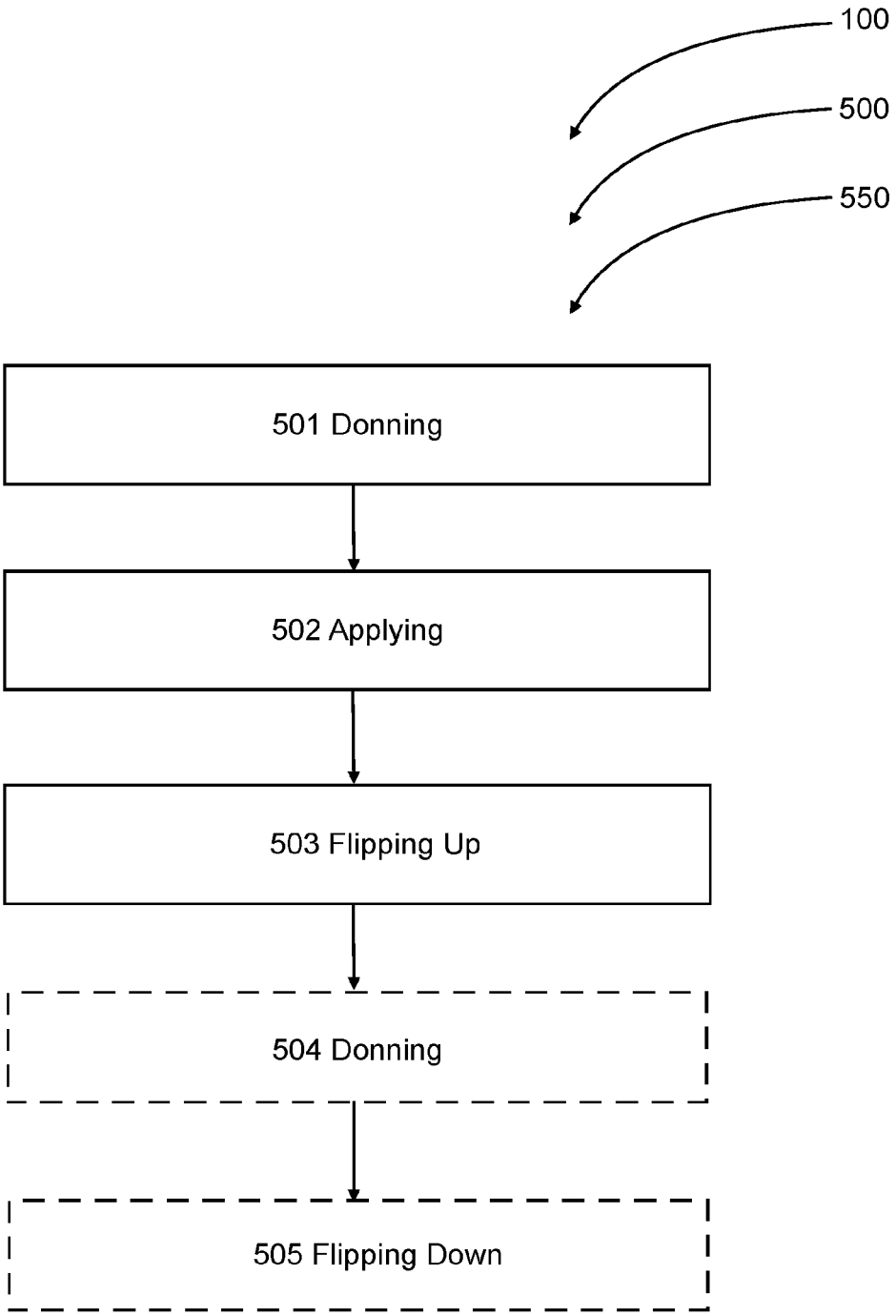
FIG. 5 is a flowchart illustrating a method of use for the flip and change system according to an embodiment of the present invention.

Referring now to FIG. 5, flowchart 550 illustrates a method of use 500 for flip and change system 100, according to an embodiment of the present invention.

Method of use 500 for flip and change system 100 comprises the steps of: step one 501 donning main-garment 160, putting on flip and change assembly 110, step two 502 applying makeup onto a face of wearer-user 104, and step three 503 flipping first garment portion 130 upwards to cover the face when removing main-garment 160 (in-use condition 150) to exchange it for wear with an alternate-garment to prevent the makeup from contacting and transferring to main-garment 160. The method may further comprise the step four 504 of donning the alternate-garment. The method may further yet comprise the step five 505 of flipping down first garment portion 130 to cover a neckline for wear with the alternate-garment in as-worn condition 170.

It should be noted that steps 504 and 505 are optional steps and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

I claim:

1. A flip and change system comprising:

a. a neck strap having a first end, a second end, and a middle section between the first end and the second end, wherein a length of the neck strap is adjustable;

b. a first garment portion, wherein the first garment portion is triangularly shaped; and c. a second garment portion, wherein the first garment portion and the second garment portion are separate portions, wherein the first garment portion and the second garment portion are connected to the middle section of the neck strap, wherein when the neck strap is positioned around a neck of a user, the first garment portion and the second garment portion move independent of one another, wherein the first garment portion flips up to cover an entire face of the user, the second garment portion tucks into a neck aperture of a garment worn by the user to anchor the flip and change system in place on the user, and wherein the second garment portion anchors the flip and change system between the garment and the user.

2. The flip and change system of claim 1, wherein the first garment portion comprises a knot for balancing the first garment portion.

3. The flip and change system of claim 1, wherein the first end of the neck strap is connected to the second end of the neck strap to form a continuous circular band.

4. The flip and change system of claim 1, wherein each of the first end and the second end comprise at least one fastener, wherein the at least one fastener of the first end matingly engages with the at least one fastener of the second end.

5. The flip and change system of claim 4, wherein the at least one fastener of the first end and the at least one fastener of the second end comprises a hook and loop fastener.

6. The flip and change system of claim 4, wherein the at least one fastener of the first end and the at least one fastener of the second end comprises snap(s).

7. The flip and change system of claim 1, wherein the at least one fastener of the first end and the at least one fastener of the second end comprises clip(s).

8. The flip and change system of claim 1, wherein the first garment portion is stain resistant.

9. The flip and change system of claim 1, wherein the second garment portion is square shaped.

10. The flip and change system of claim 1, wherein a length of the middle section to which the first garment portion is connected includes at least a length of the middle section to which the second garment portion is connected.

11. A flip and change system comprising:

a. a non-continuous adjustable neck strap having a first end, a second end, and a middle section between the first end and the second end, wherein the first end and the second end each comprise at least one fastener selected from the group consisting of a hook and loop fastener, a snap, and a clip, wherein the at least one fastener of the first end and the at least one fastener of the second end matingly engage with one another;

b. a triangularly-shaped first garment portion; and c. a square-shaped second garment portion, wherein the first garment portion and the second garment portion are separate portions, wherein the first garment portion and the second garment portion are connected to the middle section of the neck strap, wherein when the neck strap is positioned around a neck of a user, the first garment portion and the second garment portion move independent of one another, wherein the first garment portion flips up to cover a face of the user, the second garment portion tucks into a neck aperture of a garment worn by the user to anchor the flip and change system in position during use, and wherein the second garment portion anchors the flip and change system between the garment and the user.

12. The flip and change system of claim 11, wherein a length of the middle section to which the first garment portion is connected includes at least a length of the middle section to which the second garment portion is connected.

* * * * *